US006170719B1

(12) United States Patent
Wilkinson et al.

(10) Patent No.: US 6,170,719 B1
(45) Date of Patent: Jan. 9, 2001

(54) MEDICAL SAFETY CLOSURE

(75) Inventors: Bradley M. Wilkinson, North Haledon; Robert S. Golabek, Jr., Towaco, both of NJ (US)

(73) Assignee: Becton Dickinson and Company, Franklin Lakes, NJ (US)

( * ) Notice: Under 35 U.S.C. 154(b), the term of this patent shall be extended for 0 days.

(21) Appl. No.: 09/370,000

(22) Filed: Aug. 6, 1999

(51) Int. Cl.[7] ..... B67D 3/00

(52) U.S. Cl. ..... 222/479; 222/484; 222/556; 215/235; 215/236; 220/254

(58) Field of Search ..... 222/481.5, 484, 222/479, 556; 215/237, 235, 307, 309, 354; 220/254, 367.1

(56) References Cited

U.S. PATENT DOCUMENTS

| | | | | |
|---|---|---|---|---|
| 2,808,182 | * | 10/1957 | Furedi | 222/479 |
| 2,812,113 | * | 11/1957 | Beall, Jr. | 222/479 X |
| 2,812,120 | * | 11/1957 | Beall, Jr. | 222/481.5 |
| 3,059,816 | * | 10/1962 | Goldstein | 222/484 X |
| 3,220,619 | * | 11/1965 | Lodding et al. | 222/484 X |
| 3,762,612 | * | 10/1973 | Miller | 222/479 |
| 3,782,610 | * | 1/1974 | Gilbert | 222/484 |
| 4,753,358 | * | 6/1988 | Virca et al. | 215/306 X |
| 5,119,975 | * | 6/1992 | Jemielita | 222/479 X |
| 5,361,921 | | 11/1994 | Burns | 215/320 |
| 5,377,882 | * | 1/1995 | Pham et al. | 222/479 |
| 5,456,886 | | 10/1995 | Burns | 422/103 |
| 5,458,113 | | 10/1995 | Burns | 128/763 |
| 5,494,170 | | 2/1996 | Burns | 215/247 |
| 5,552,117 | | 9/1996 | Burns | 422/102 |
| 5,632,396 | | 5/1997 | Burns | 215/247 |
| 5,699,923 | | 12/1997 | Burns | 215/247 |
| 5,738,233 | | 4/1998 | Burns | 215/247 |
| 5,779,074 | | 7/1998 | Burns | 215/247 |

* cited by examiner

*Primary Examiner*—Kenneth Bomberg

(57) ABSTRACT

A specimen safety closure is provided for sealing an open top of a test tube during the collection, transfer, and shipment of specimens to analytical laboratories. The closure includes an oblong transfer port for allowing transfer of the liquid specimen from a male reservoir outlet into the tube. A barrier wall and annular skirt provide leakage protection from the test tube connection. Also included is a cylindrical vent tube extending from the bottom of the safety closure. The vent tube has a supporting disk which has a very small hole in its bottom to provide venting. The vent tube also performs the function of filling the tube passively while stopping the liquid specimen from filling at a predetermined volume. Both the transfer port and vent tube are located off the center axis for providing maximum filling speed. The transfer port and vent tube are positioned in opposite directions for providing uninterrupted transfer of the liquid specimen. The safety closure further includes a snap lid. The snap lid has an annular snap ring, a portal mating plug, and a frangible tab. The annular snap ring and the portal mating plug seals the cap to allow liquid-tight transportation of the specimen within the test tube for shipment to a testing facility. The annular snap on the snap lid is a one-time operation and removal of the cap is only facilitated by twisting off the cap. Thus, safety from the spray of the specimen by removal of the snap lid is avoided. The frangible tab on the snap lid provides tamper resistance and further protection from specimen spray by breaking off when excessive force is applied to the tab in attempts to defeat the lock of the annular snap ring.

15 Claims, 6 Drawing Sheets

MEDICAL SAFETY CLOSURE

BACKGROUND OF THE INVENTION

1. Field of Invention

The present invention relates to a medical safety closure for sealing an open top of a specimen collection tube. More particularly, the present invention relates to a medical specimen safety closure used during the collection and shipment of biological specimens, such as urine, to analytical laboratories.

2. Background Description

Biological specimen collections are frequently performed in physicians' offices, hospitals and clinics. It is then sent out to the laboratory for diagnostic testing. Urine collection is one of the most notable. The usual procedure to carry out a urine test is to have one's urine collected and then shipped to an analytical laboratory. The specimen is usually collected in a physician's office where the patient is asked to fill some type of container and then return it to the healthcare provider. The specimen is then transferred from the reservoir container into some shipping container and mailed out to an analytical laboratory for diagnostic analysis.

A problem with current devices that are utilized to carry out this specimen collection is that during the transfer of the specimen from the primary collection device to the transport device, the healthcare provider can be exposed to the specimen. There is a current need to provide safe transfer of the specimen from the reservoir to the shipping container. In addition, there is a need to provide a closure which has a liquid-tight seal so that the specimen does not leak out during transport to the analytical laboratory.

It is also important to provide a safety feature to the closure so that the laboratory technician cannot defeat the medical safety closure's lid and potentially become exposed to the specimen by splatter or spray when the lid is re-opened.

Furthermore, it is desirable to have these above features and advantages with a closure that provides passive filling of the specimen which also stops the liquid specimen from filling at a pre-determined volume. As those skilled in the field of specimen collection are aware, safety is becoming more important due to the exposure to the specimen and the possible infectious disease it may carry. Therefore, there is an ever-increasing need for a specimen closure that minimizes exposure of the specimen to the healthcare provider during collection and transfer of the specimen from a reservoir to a container. In addition, there is a need for a closure to be fluid-tight during shipping of the specimen and a feature to prevent tampering of the closure's lid that could lead to exposure of the specimen from spray or splatter caused by the re-opening of the lid. Currently, stoppers are used that must be pulled out of the containers which can cause splatter or spray of the specimen out of the container. Closures which have a permanent snap fit and only allow removal of the closure by twisting off of the container may be defeated if enough force is applied to the lid of the closure.

SUMMARY OF THE INVENTION

The present invention overcomes the problems identified in the background material. The preferred embodiment of the safety specimen closure comprises a base having an open upper portion, a lower portion and side walls therebetween. The side walls have at least one detent. The lower portion has an annular skirt and a barrier wall extending distally. The annular skirt is attached to the tube by having at least one internal protrusion and the tube having at least one external protrusion. The tube is secured between the annular skirt and barrier wall to provide leakage protection from the tube and closure connection. A transfer port for internally receiving the male reservoir outlet is attached to the lower portion and extends towards the open upper portion. The transfer port is offset from the center of the lower portion and has a hole that is oblong in shape for maximum filling speed. The oblong transfer port where a male reservoir outlet is received inside the transfer port assists in avoiding any spillage or leakage that may occur by having the specimen from the container directly poured into the transport container or tube, instead of having a male receptacle over the transfer port of the closure which may result in leakage of the specimen.

A vent tube is mounted on the lower portion between the transfer port and side walls. The vent tube extends adjacent to the annular skirt and has a conduit therethrough such that the diameter of the conduit is larger at the lower portion than at the distal end of the vent tube adjacent to the annular skirt.

The closure further includes a snap lid hingedly connected to the base. The snap lid has at least one coupler or annular ring and a portal mating plug such that when the snap lid is rotated onto the open upper portion of the closure, the portal mating plug securely attaches into the transfer port and the coupler permanently attaches to the detent on the side walls. This feature provides a liquid-tight seal suitable for shipment and prevents the snap lid from being re-opened. Further prevention of re-opening the snap lid is provided by a tab being frangibly and flexibly mounted on the snap lid which detaches when force is applied to re-open the snap lid. This frangible tab is strong enough to press the snap lid onto the open upper portion but breaks off making it unusable when attempts are made to re-open the lid. A plurality of vertical ribs mounted on the side walls of the closure further provide safety by allowing secure gripping of the closure.

The closure further includes a supporting disk attached to the distal end of the vent tube. The supporting disk has an aperture therethrough that has a diameter smaller than the diameter of the conduit of the vent tube adjacent to the annular skirt. The supporting disk provides for passive filling of the specimen into the specimen collection tube. The supporting disk also provides for the specimen to stop filling at a certain predetermined volume based on the height of the supporting disk from the bottom of the specimen collection tube.

These and other aspects, features and advantages of the present invention is apparent from the following detailed description taken in conjunction with the accompanying drawings and claims.

DETAILED DESCRIPTION

Figure 1:
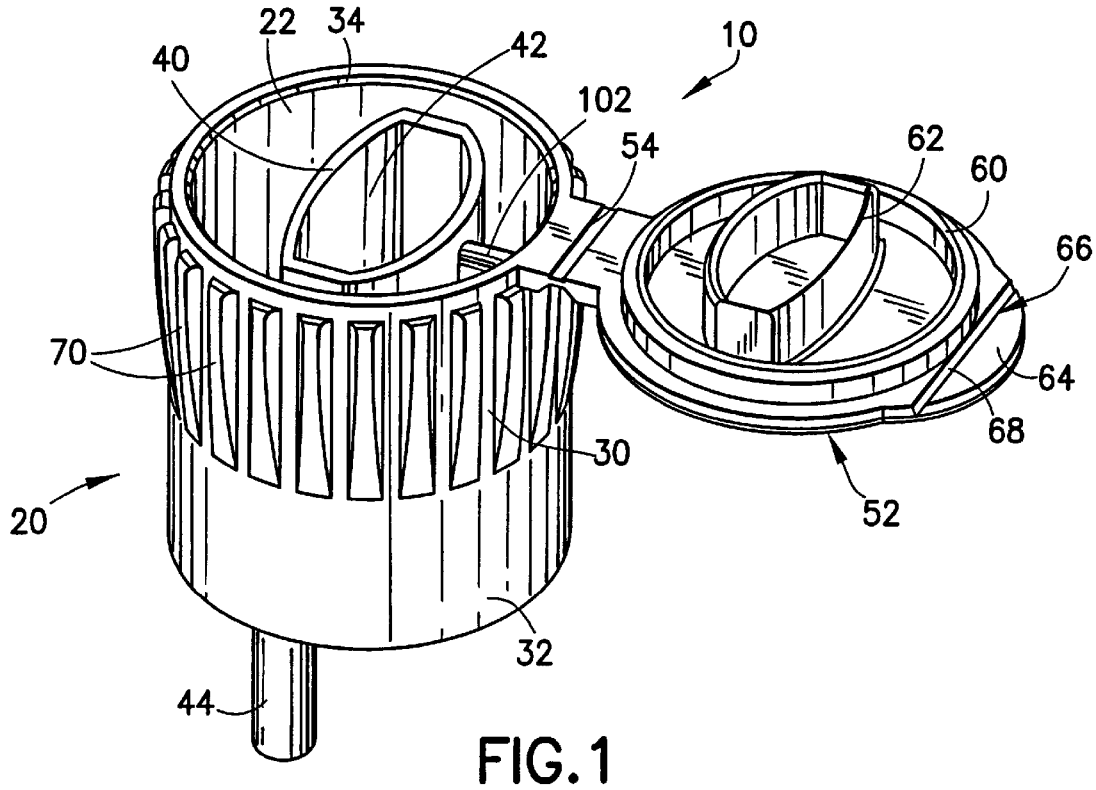
FIG. 1 is a perspective view of the medical safety closure in accordance with the subject invention.
Figure 2:
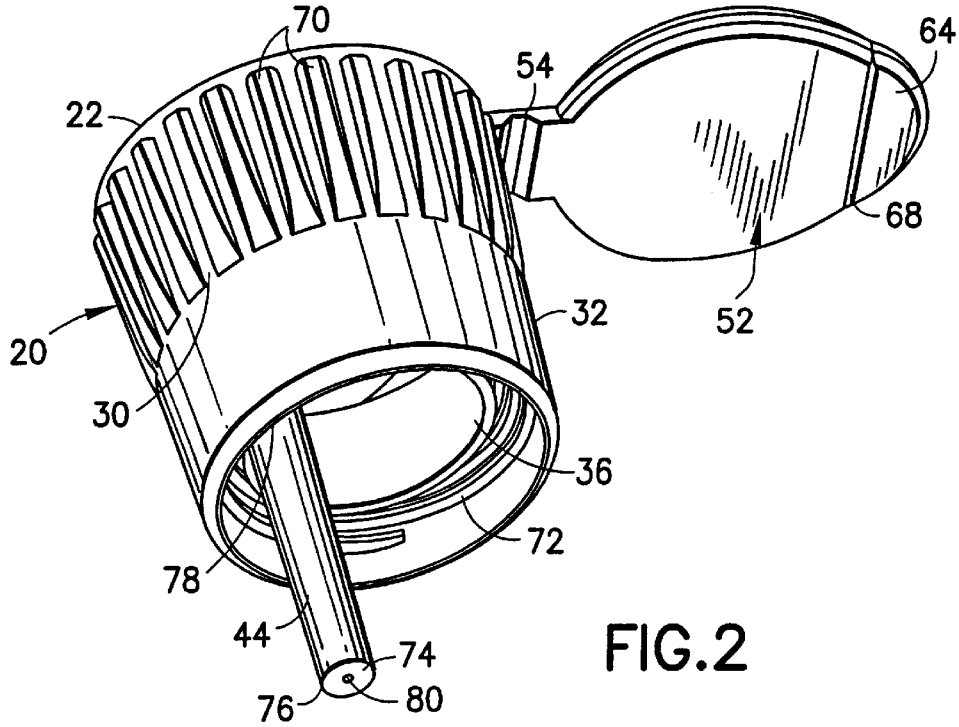
FIG. 2 is a bottom perspective view of the closure shown in FIG. 1.

While this invention is satisfied by embodiments in many different forms, there is herein described in detail preferred embodiments of the invention with the understanding that the present disclosure is to be considered as exemplary of the principles of the invention and is not intended to limit the invention to the embodiments illustrated and described. The scope of the invention is measured by the appended claims and their equivalents.

A medical safety closure 10 and a medical safety closure collection system 82 in accordance with the subject invention is identified generally in FIGS. 1–11. Closure 10 as shown in FIGS. 1–5, includes a base 20 having an open upper portion 22, a lower portion 24, and side walls 30 therebetween. Side walls 30 have a length "F". Base 20 is preferably cylindrical in shape, however, other shapes could be provided such as polygonal, elliptical, and/or orthogonal for providing maximum gripping area. Side walls 30 could be similarly shaped in different structures as base 20. Lower portion 24 includes an annular skirt 32 and a barrier wall 36 both extending distally from lower portion 24. Annular skirt 32 has a length "H". Barrier wall 36 has a length "J. Side walls 30 include at least one detent 34. Detent 34 is preferably positioned inside side walls 30. However, detent 34 may be placed on the outside of side walls 30.

Figure 3:
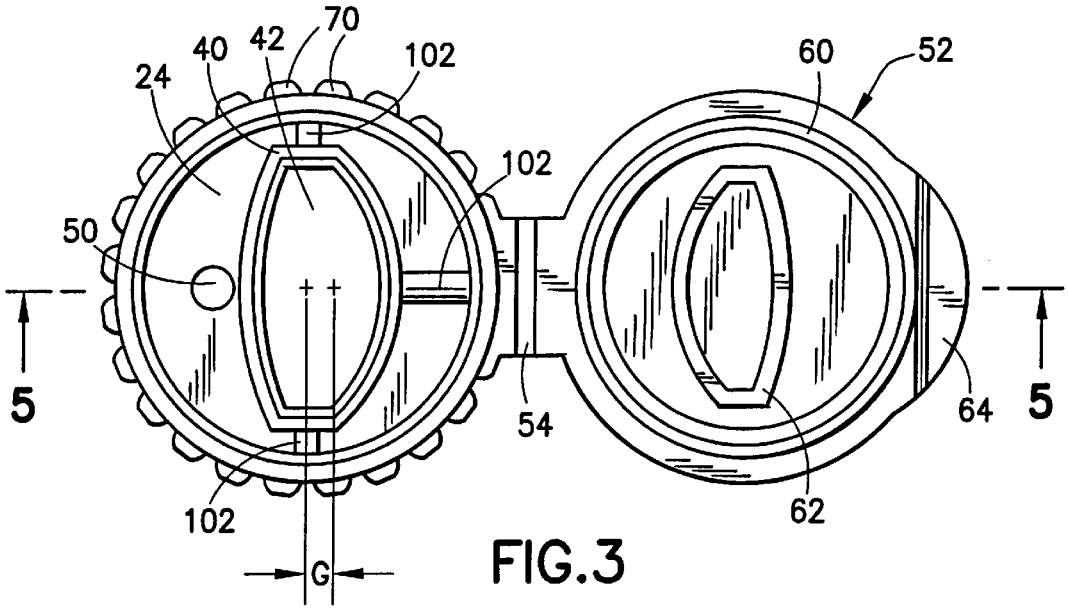
FIG. 3 is a top plan view of the closure shown in FIG. 1.
Figure 5:
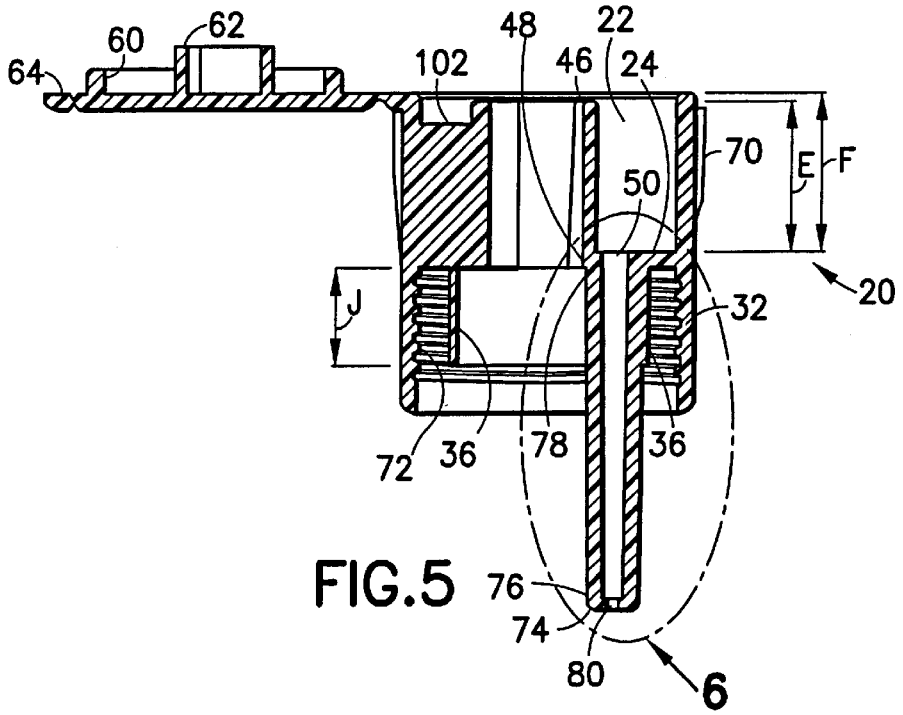
FIG. 5 is a cross-sectional view taken along line 5—5 in FIG. 3.
Figure 6:
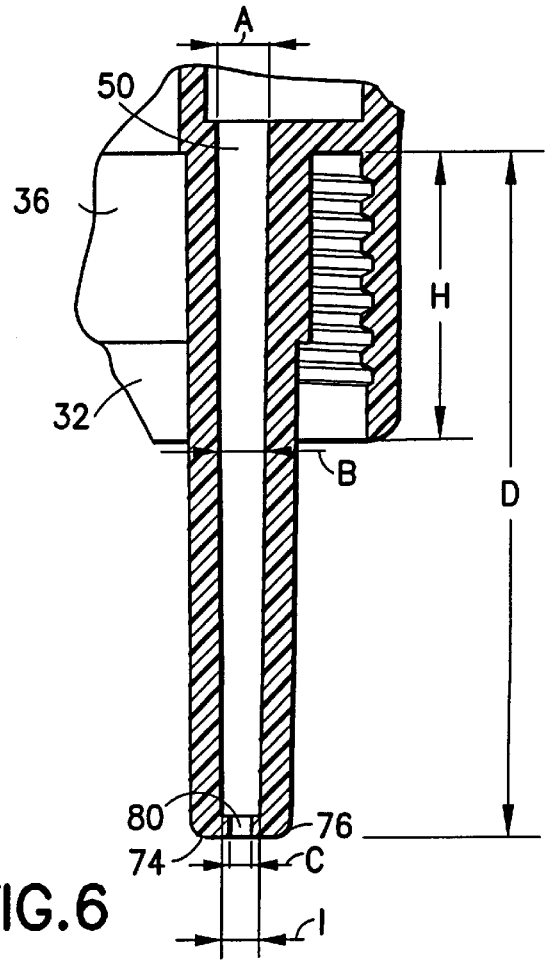
FIG. 6 is an enlarged cross-sectional view of FIG. 5.

A transfer port 40 is further included in closure 10. Port 40 has a distal end 46, a proximal end 48, and a length "E". Proximal end 48 of transfer port 40 is attached to lower portion 24 and distal end 46 extends toward open upper portion 22. Transfer port 40 is offset from the center of lower portion 24 for providing maximum filling speed and minimizing interference during transfer of the specimen. As shown in FIG. 3, transfer port 40 is offset from the center of lower portion 24 by a distance "G". Transfer port 40 includes a hole 42 for internally receiving a male reservoir outlet 14 and allowing the specimen to safely transfer into a specimen collection tube 12. Tube 12 has an open top 94, a closed bottom 96 and cylindrical side walls 98. Preferably, transfer port 40 is oblong shaped for providing maximum filling speed of the specimen in tube 12. However, other shapes can be provided, such as circular or elliptical. As shown in FIG. 3, transfer port 40 further includes an array of supporting ribs 102 disposed circumferentially around transfer port 40 and attached to side walls 30. Ribs 102 minimizes the amount of deflection of transfer port 40 from the insertion of male reservoir outlet 14 during transfer of the speciman. Thus, ribs 102 reduce the potential of the specimen leaking out. As shown in FIGS. 5–6, closure 10 further includes a vent tube 44 having a proximal end 78 and a distal end 76. Proximal end 78 is mounted on lower portion 24 between transfer port 40 and side walls 30. Vent tube 44 extends adjacent to annular skirt 32. Vent tube 44 is preferably cylindrical in shape but does not have to be so shaped to function. Vent tube 44 further includes a conduit 50 therethrough. Conduit 50 has a diameter "A" located at lower portion 24 and a diameter "B" at annular skirt 32. Diameter A is larger than diameter B. Vent tube 44 further includes a supporting disk 74 attached to distal end 76. Supporting disk 74 has an aperture 80 therethrough that has a diameter "C". Diameter "C" is smaller than diameter "B" of conduit 50. Vent tube 44 has a length "D". Length "D" and the position of supporting disk 74 determines the amount of specimen that enters tube 12. Conduit 50 at distal end 76 has a diameter "I".

The vent tube 44 preferably protrudes distally beyond annular skirt 32. Length "D" is greater than length "E". Preferably, length "F" of side walls 30 is greater than length "E" of port 40 and length "H" of annular skirt 32 is smaller than length "D" of vent tube 44. However, these size relationships can be reversed and the length "E" of port 40 can be greater than length "F" of side wall 30. In addition, length "H" of annular skirt 32 can be greater than length "D" of vent tube 44. Aperture 80 having diameter "C" is sized to prevent the passage of fluid, but allow the passage of air to vent through. Length "D" and the position of supporting disk 74 determines the amount of specimen that enters tube 12. Vent tube 44 allows passive filling and length "D" and the position of supporting disk 74 from closed bottom 96 of tube 12 predetermines the volume to be transferred in tube 12.

Vent tube 44 is further characterized by a method to manufacture vent tube 44. Vent tube 44 can be an extruded tube with a small inside diameter equivalent in size to diameter "C". This alternate embodiment utilizes a press fit on the extruded tube to attach vent tube 44 on lower portion 24. This embodiment allows the simple cutting of the extrusion to vary the volume in tube 12. The advantage of this embodiment is efficiency in manufacturing and flexibility associated with the ease in variation of specimen volume by simply changing the cut length of vent tube 44.

Closure 10 further includes a snap lid 52 hingedly connected by a hinge 54 to base 20. Snap lid 52 includes at least one annular snap ring 60 and a portal mating plug 62. Annular snap ring 60 is positioned on snap lid 52 to correspond with detent 34 on side walls 30 when snap lid 52 is rotated onto open upper portion 22 of closure 10. Portal mating plug 62 is positioned on snap lid 52 to correspond with and enter hole 42 of transfer port 40 when snap lid 52 is rotated onto open upper portion 22.

Figure 4:
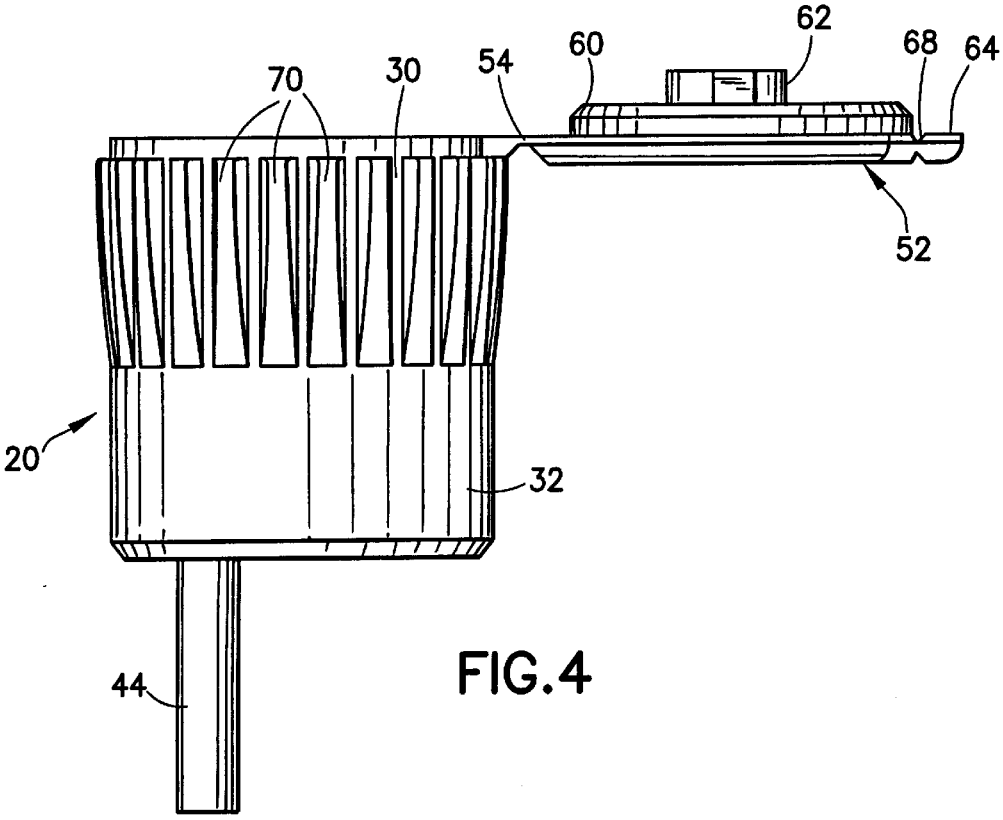
FIG. 4 is a side view of the closure shown in FIG. 1.
Figures 10, 11:
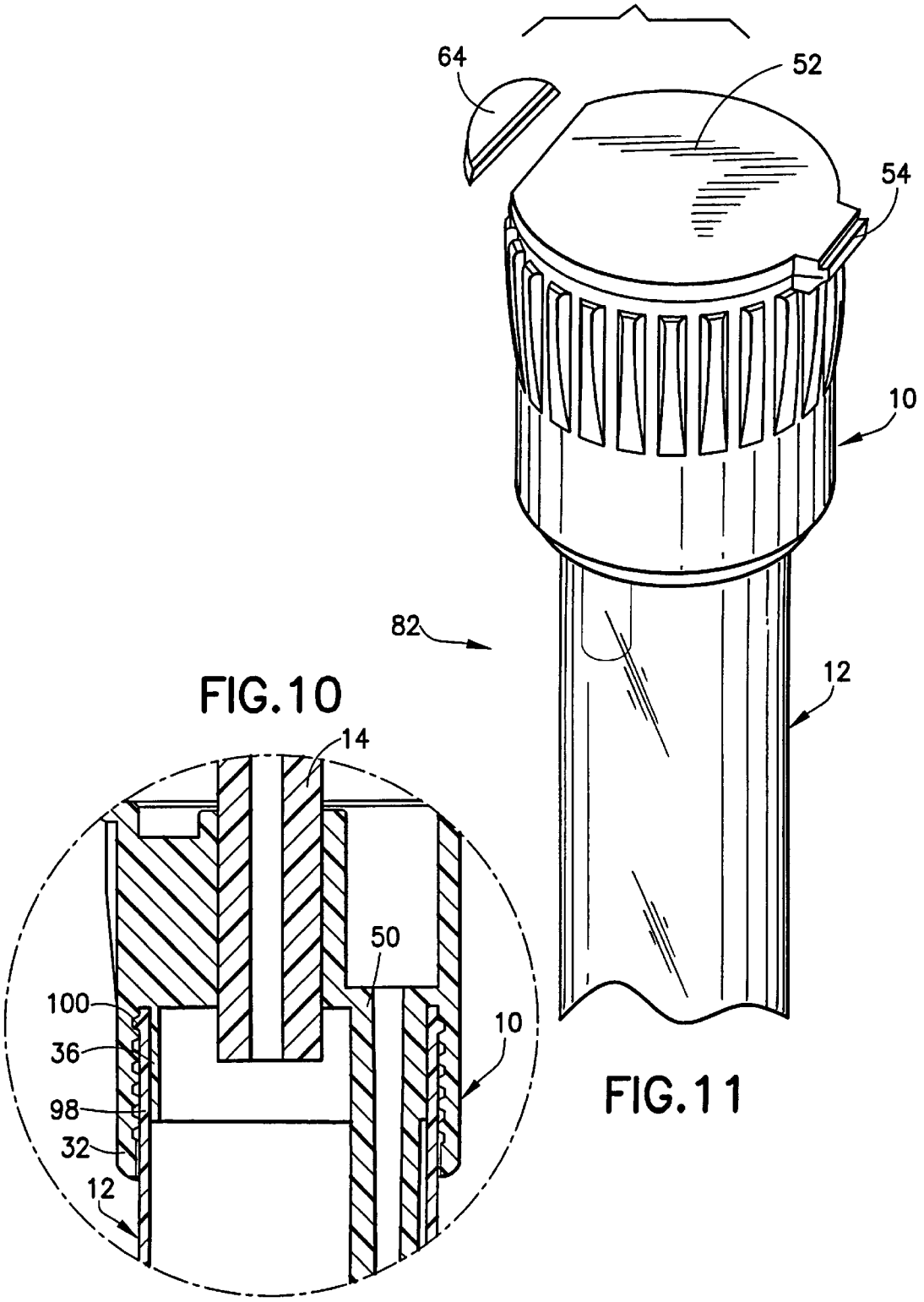
FIG. 10 is an enlarged cross-sectional view of FIG. 9.
FIG. 11 is an enlarged side elevational view of the closure in FIG. 1 attached to a tube with a snap lid in the closed position.

As shown in FIGS. 1, 4 and 11, snap lid 52 further includes a tab 64 for pressing snap lid 52 onto open upper portion 22. Tab 64 is frangibly and flexibly mounted on snap lid 52 which provides for detachment of tab 64 when force is applied to re-open snap lid 52. Closure 10 further comprises a plurality of vertical ribs 70 mounted on side walls 30 for securely gripping closure 10. Tab 64 includes a frangible zone 66 for detaching tabs 64 when force is applied to re-open snap lid 52. Frangible zone 66 preferably has a score line 68. There are other methods well known to those skilled in the art to make such a frangible zone. Such methods include but are not limited to using frangible or brittle material such as styrene, using a reduced thickness area and using stress concentrations such as sharp edges or non-radiused corners. Annular skirt 32 further comprises at least one internal protrusion 72 for attachment of closure 10 onto tube 12. Barrier wall 36 provides leakage protection from the attachment of closure 10 onto tube 12.

Figure 7:
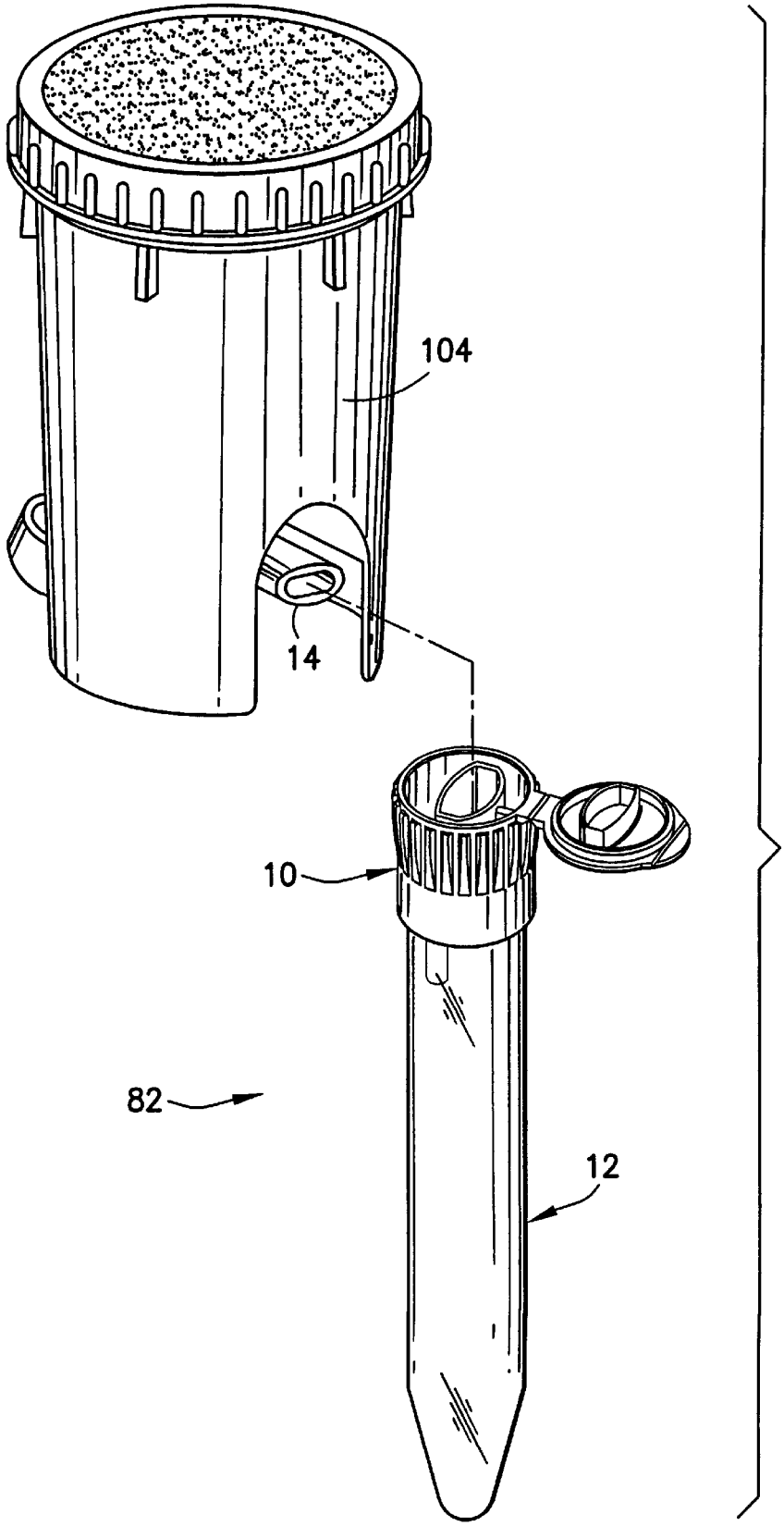
FIG. 7 is an exploded perspective view of the closure shown in FIG. 1 attached to a specimen collection tube and a male reservoir outlet.
Figure 8:
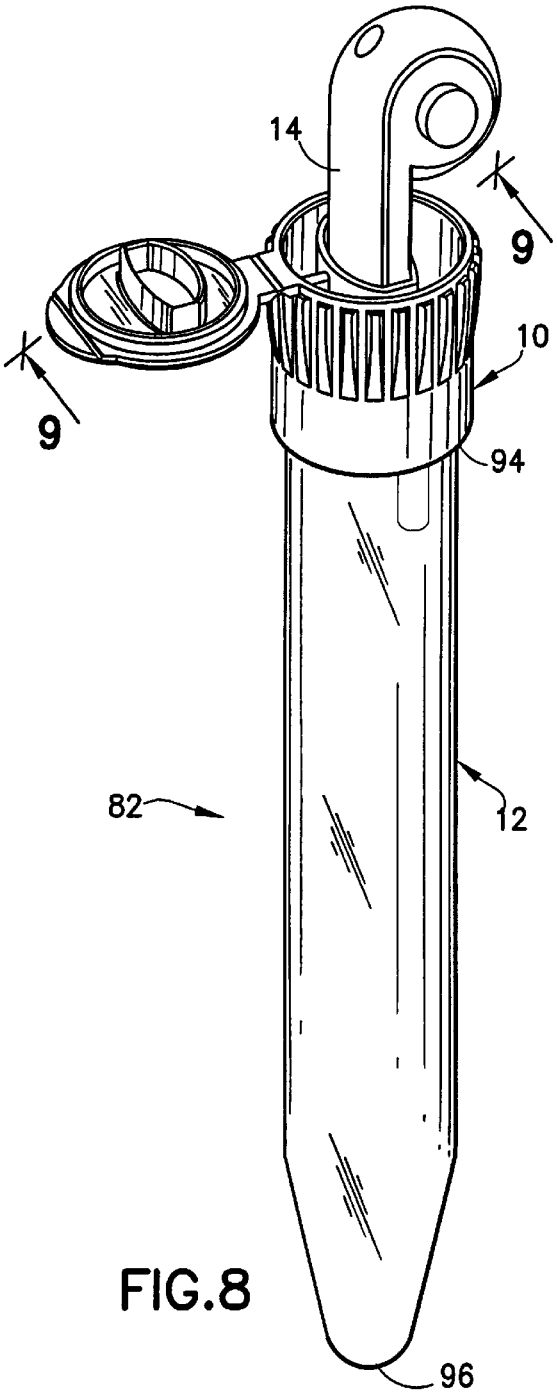
FIG. 8 is a side elevational view of the closure mounted to the male reservoir outlet in FIG. 7.

Medical safety closure collection system 82 includes closure 10 and tube 12 as shown in FIG. 7. Tube 12 has an open top 94, a closed bottom 96 and cylindrical side walls 98. Tube 12 further includes an external thread 100. External thread 100 is used to attach test tube 12 to at least one internal protrusion 72 of closure 10. External thread 100 is the preferred geometry of the subject invention. However, threads can be mounted on the inside of tube 12 and detents can be mounted on the outside of closure 10 to facilitate attachment of closure 10 to tube 12.

Figure 9:
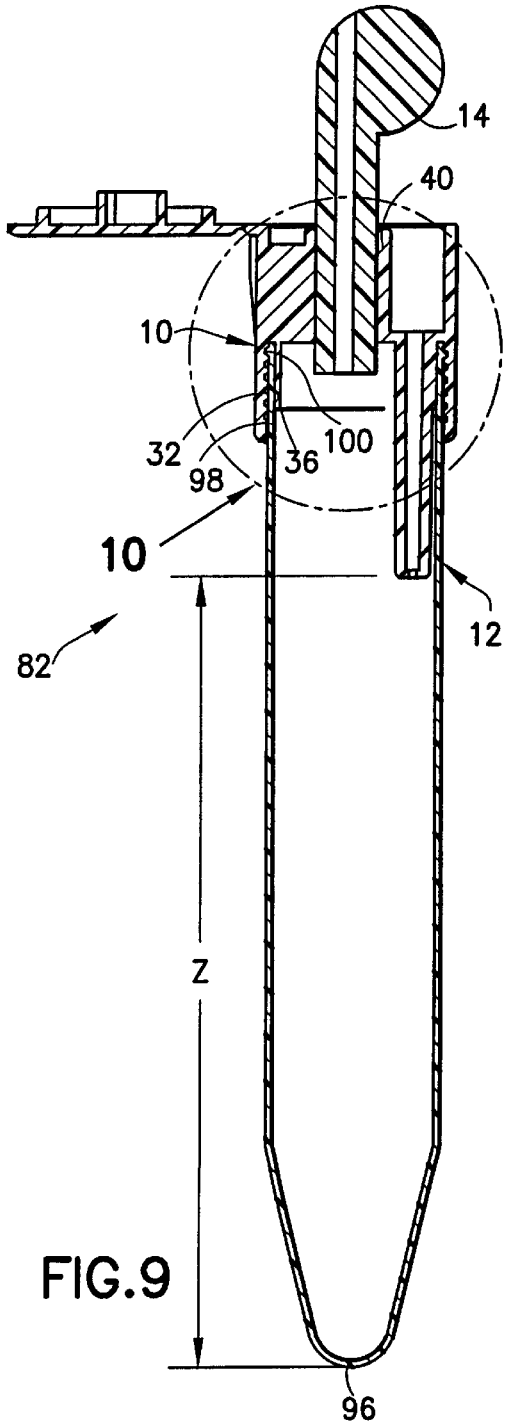
FIG. 9 is a cross-sectional view taken along line 9—9 in FIG. 8.

As shown in FIG. 7, medical safety closure collection system 82 includes closure 10 and tube 12. Preferably, closure 10 is threadedly mounted to tube 12 as shown in FIG. 9. Barrier wall 36 is positioned inside tube 12 when closure 10 is mounted onto tube 12. Thus, cylindrical side walls 98 of tube 12 is between annular skirt 32 and barrier wall 36 to prevent leakage from the tube connection. Barrier wall 36 prevents the specimen from leaking out of tube 12 and onto the annular skirt 32. External thread 100 and protrusion 72 are both preferably matching threads. However, it is within the scope of the invention that external thread 100 and protrusion 72 could be any type of removable fastener known to one skilled in the art such as removable snap fits, slip fits or frictional fittings and sleeve locks. Closure 10 is preferably made from a polymeric material such as polyethylene or polypropylene. Test tube 12 is preferably glass. However, test tube 12 can also be made of a polymeric material such as polystyrene, polyethylene terephthalate, polycarbonate or any blends thereof.

After a sufficient volume of liquid specimen has been collected such as in a collection container 104 shown in FIG. 7, the male reservoir outlet 14 attached to collection container 104 is mounted inside transfer port 40. By mounting male reservoir outlet 14 inside transfer port 40 spillage and leakage is minimized. Transfer port 40 is stabilized by supporting ribs 102 as shown in FIG. 1. Ribs 102 minimizes the amount of deflection of transfer port 40 during transfer of the specimen from the collection container 104 to the specimen collection tube 12 which is later shipped to a lab for analysis. Length "D" of vent tube 44 and the position of disk 80 relative to bottom 96 determines the amount of fluid specimen that is deposited in test tube 12. Also a factor in the amount of fluid specimen deposited in tube 12 is a length "Z" which is the distance from bottom 96 to disk 80, and represents the total volume of the specimen to be filled in tube 12. Distal end 76 of vent tube 44 and aperture 80 is blocked to inhibit further flow of the specimen into test tube 12.

Once transfer of the liquid specimen from the reservoir or collection container 104 to the specimen collection tube 12 is completed, medical safety closure system 82 is removed from male reservoir outlet 14. Snap lid 52 is rotated about hinge 54 to cover open upper portion 22. Portal mating plug 62 mates with hole 42 in transfer port 40 to provide a liquid-tight seal. Annular snap ring 60 mates with inner detent 34 of side walls 30 to permanently secure snap lid 52 onto open upper portion 22. Annular snap ring 60 also provides additional liquid-tight sealing of the specimen in tube 12. This additional protection is provided since the snap ring completely surrounds open upper portion 22 and creates a complete seal around open upper portion 22. Preferably, annular snap ring 60 and inner detent 34 are inside side walls 30. However, annular snap ring 60 could be configured to seal on the outside of side walls 30. The filled and sealed test tube may be then transported to a laboratory for analysis without risk of spillage or contamination of the specimen or nearby personnel.

During the transfer of the liquid specimen from the reservoir or collection container 104 to the specimen collection tube 12, the oblong shape of transfer port 40 and the off-center position of transfer port 40 and vent tube 44 allows a maximum transfer speed of the liquid specimen from the reservoir or collection container 104 to specimen collection tube 12. Once snap lid 52 is securely mounted on open upper portion 22 the liquid specimen can only be reached by unscrewing closure 10 from tube 12. If snap lid 52 is attempted to be re-opened, tab 64 breaks along score line 68 thereby preventing the re-opening of snap lid 52. Once tab 64 has been detached, snap lid 52 has no gripping surface to assist in its re-opening. Vertical ribs 70 on side walls 30 allow for securely gripping closure 10 while unscrewing closure 10 from test tube 12. This feature further reduces the risk of spillage or contamination of the specimen on nearby personnel.

The embodiments depicted in FIGS. 1–11 are intended to merely be exemplary, and are not intended to depict all possible collection containers that may be used with closure 10 and medical safety closure system 82. Rather, closure 10 and medical safety closure system 82 can be used with any container having an appropriately dimensioned male outlet. The ability to transfer a specimen sample from a reservoir to a specimen collection tube by having a male outlet inside transfer port 34 of closure 10 minimizes the potential for leakages or spills. Furthermore, the volume of the specimen collected can be easily varied by adjusting length "D" of vent tube 44. The incorporation of portal mating plug 62 and annular snap ring 60 on closure 10 provides prevention for potential leakages or spills during shipping by permanently attaching snap lid 52 on open upper portion 22 and providing a liquid-tight seal. Tabs 64 being frangibly and flexibly mounted on snap lid 54 provides for tamper resistance and protection against potential leakages and spills of the specimen during re-opening of closure 10. As shown in FIG. 11, this protection is provided by tab 64 detaching when force is applied to reopen snap lid 54 after closure. The geometry and position of transfer port 40 and hole 42 as well as the position of vent tube 44 allows minimal interference during transfer of the specimen from the reservoir or collection container 104 to tube 12. Transfer port 40 and vent tube 44 are positioned in opposite directions for providing uninterrupted transfer of the liquid specimen. These geometries and positions also provide for maximum filling speed between the reservoir or collection container 104 and the specimen collection tube 12.

What is claimed is:

1. A medical safety closure for use with a specimen collection tube and a male reservoir outlet, comprising:

a base having an open upper portion, a lower portion, and a side wall therebetween, said lower portion having an annular skirt and a barrier wall extending distally therefrom, said side walls having at least one detent, said annular skirt attachable to the tube such that the tube is being secured between said annular skirt and said barrier wall;

a transfer port attached to said lower portion and extending toward said open upper portion, said transfer port offset from the center of said lower portion and having a hole therethrough for internally receiving the male reservoir outlet and allowing liquid transfer into the tube, said transfer port further including an array of supporting ribs disposed circumferentially around said transfer port and attached to said wall; and a vent tube having proximal and distal ends mounted on said lower portion between said transfer port and said side walls, said vent tube extending adjacent to said annular skirt and having a conduit therethrough such that the diameter of said conduit is larger at said lower portion than at said distal end of said vent tube adjacent to said annular skirt.

2. The closure of claim 1, further comprising a snap lid hingedly connected to said base, said snap lid having at least one annular snap ring and a portal mating plug such that when said snap lid is rotated onto said open upper portion said portal mating plug securely attaches into said transfer port and said annular snap ring permanently attaches to said detent for providing a liquid-tight seal and preventing said snap lid from re-opening.

3. The closure of claim 2, wherein said snap lid further includes a tab for pressing said snap lid onto said open upper portion, said tab frangibly and flexibly mounted on said snap lid for detaching said tab when force applied to open said snap lid.

4. The closure of claim 1, further comprising a plurality of vertical ribs mounted on said side walls for securely gripping the closure.

5. The closure of claim 1, further comprising at least one internal protrusion on said annular skirt for attachment of the closure onto the tube.

6. The closure of claim 1, wherein said transfer port is oblong in shape.

7. The closure of claim 1, wherein said vent tube further includes a supporting disk attached to the distal end of said vent tube, said supporting disk having an aperture therethrough that has a diameter smaller than the diameter of said conduit of said vent tube adjacent to said annular skirt.

8. The closure of claim 1, wherein said vent tube protrudes distally beyond said annular skirt.

9. A medical safety closure collection system for use with a male reservoir outlet, comprising:

a cylindrical base having an open upper portion, a lower portion, and side walls therebetween, said lower portion having an annular skirt and a barrier wall extending distally therefrom, said side walls having at least one inner detent, and said annular skirt having at least one internal thread;

a test tube having an open top, a closed bottom, and cylindrical side walls therebetween, said open top having at least one external thread for attaching to said internal thread of said annular skirt such that said tube being secured between said annular skirt and said barrier wall;

an oblong transfer port attached to said lower portion and extending toward said open upper portion to a distance below said open upper portion, said transfer port offset from the center of said lower portion and having a hole therethrough for internally receiving the male reservoir outlet and allowing liquid transfer into said test tube, said transfer port further including an array of supporting ribs disposed circumferentially around said transfer port and attached to said side walls;

a cylindrical vent tube having proximal and distal ends and mounted on said lower portion between said transfer port and said side walls, said vent tube extending beyond said annular skirt and having a conduit therethrough, said vent tube further including a support disk at said distal end of said vent tube, said support disk having an aperture such that the diameter of said aperture is smaller than the diameter of said conduit at said distal end of the vent tube; and a snap lid hingedly connected to said side walls, said snap lid having an annular snap ring, a portal mating plug, and a tab frangibly and flexibly mounted on said snap lid for pressing said snap lid onto said open upper portion, said portal plug securely attaching into said transfer port and said snap ring permanently attaching to said inner detent on said side walls when said snap lid rotates onto said open upper portion, said tab detaching when force applied to open said snap lid.

10. A medical safety closure for use with a specimen collection tube and a male reservoir outlet, comprising:

a cylindrical base having an open upper portion, a lower portion, and side walls therebetween, said lower portion having an annular skirt and a barrier wall extending distally therefrom, said side walls having at least one inner detent, and said annular skirt having at least one internal thread for attaching to the tube such that the tube being secured between said annular skirt and said barrier wall;

a transfer port attached to said lower portion and extending toward said open upper portion to a distance below said open upper portion, said transfer port offset from the center of said lower portion and having a hole therethrough for internally receiving the male reservoir outlet and allowing liquid transfer into the tube;

a cylindrical vent tube having proximal and distal ends and mounted on said lower portion between said transfer port and said side walls, said vent tube extending beyond said annular skirt and having a conduit therethrough such that the diameter of said conduit is larger at said lower portion than at said distal end of said vent tube beyond said annular skirt; and a snap lid hingedly connected to said side walls, said snap lid having an annular snap ring and a portal mating plug such that when said snap lid is rotated onto said open upper portion said portal mating plug securely attaches into said transfer port and said annular snap rings permanently attaches to said inner detent.

11. The closure of claim 10, wherein the transfer port is oblong in shape.

12. The closure of claim 10, further comprising a plurality of vertical ribs mounted on said side walls for securely gripping the closure.

13. The closure of claim 10, wherein said snap lid further includes a tab frangibly and flexibly mounted on said snap lid for pressing said snap lid onto said open upper portion, said tab detaching when force applied to open said snap lid.

14. The closure of claim 10, wherein said cylindrical vent tube further, includes a supporting disk attached to said distal end of said cylindrical vent tube, said supporting disk having an aperture therethrough that has a diameter smaller than the diameter of said conduit of said cylindrical vent tube extending beyond said annular skirt.

15. The closure of claim 10, wherein said transfer port further includes an array of supporting ribs disposed circumferentially around said transfer port and attached to said side walls.

* * * * *